United States Patent [19]

Saka et al.

[11] Patent Number: 5,003,966

[45] Date of Patent: Apr. 2, 1991

[54] SUCTION DEVICE

[75] Inventors: Kenji Saka, Kanagawa; Masao Terai, Hyogo; Kanji Yamamoto, Osaka, all of Japan

[73] Assignee: Kanebo, Ltd., Osaka, Japan

[21] Appl. No.: 420,865

[22] Filed: Oct. 13, 1989

[30] Foreign Application Priority Data

Oct. 15, 1988 [JP] Japan ..... 63-134645

[51] Int. Cl.[5] ..... A61H 7/00

[52] U.S. Cl. ..... 128/39; 128/64

[58] Field of Search ..... 128/64, 38, 39, 67, 128/52, 56, 54, 65, 66, 355; 137/202, 205

[56] References Cited

U.S. PATENT DOCUMENTS

| | | | |
|---|---|---|---|
| 1,898,652 | 2/1933 | Williams | 128/64 X |
| 2,228,676 | 1/1941 | Renga | 128/52 |
| 2,234,102 | 3/1941 | Andres | 128/52 |
| 3,736,921 | 6/1973 | Kawada | 128/56 |
| 3,818,904 | 6/1974 | Kawada | 128/56 |
| 4,378,804 | 4/1983 | Cortese, Jr. | 128/56 X |
| 4,607,627 | 8/1986 | Leber et al. | 128/66 |

FOREIGN PATENT DOCUMENTS

| | | |
|---|---|---|
| 60-41956 | 12/1985 | Japan . |
| 61-30674 | 9/1986 | Japan . |

*Primary Examiner*—Edgar S. Burr
*Assistant Examiner*—Moshe I. Cohen
*Attorney, Agent, or Firm*—Armstrong, Nikaido, Marmelstein, Kubovcik & Murry

[57] ABSTRACT

The invention relates to a facial suction device for massaging facial skin and the like by suction, and its object is to controll suction force appropriately and operation noise small.

The suction device according to the invention includes a suction pump comprising a diaphragm 9 of which the center part is formed in a dome section 11, a suction valve 13*a* and an exhaust valve 13*b* both made of thin plate and disposed on the end of the diaphragm. And the dome section 11 of said diaphragm 9 is expanded and contracted by the rotation of an eccentric shaft of a motor 4, thereby the suction valve 13*a* and the exhaust valve 13*b* are operated to conduct sucking against the face.

3 Claims, 3 Drawing Sheets

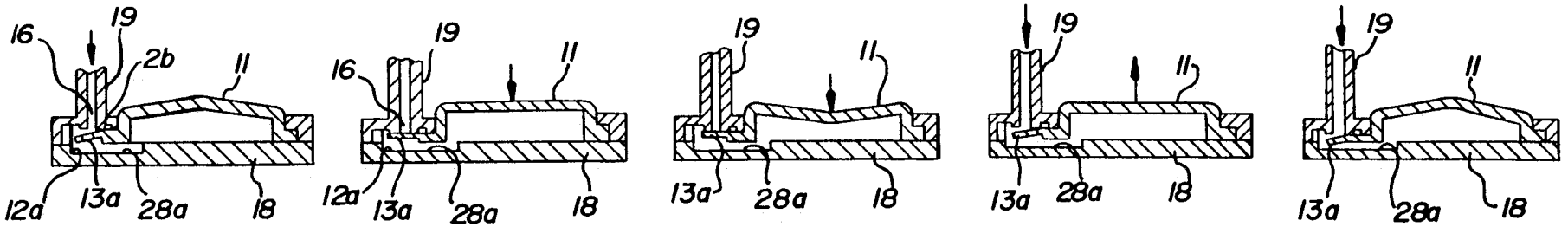
FIG.7(a)
FIG.7(b)
FIG.7(c)
FIG.7(d)
FIG.7(e)
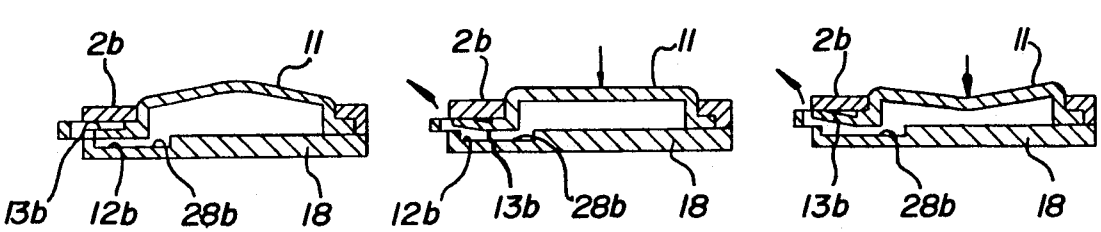
FIG.8(a)
FIG.8(b)
FIG.8(c)
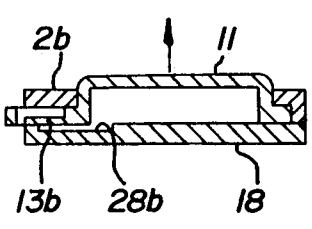
FIG.8(d)
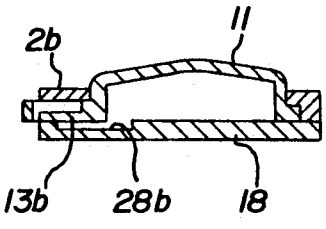
FIG.8(e)

SUCTION DEVICE

FIELD OF THE INVENTION

This invention relates to a facial suction device for massaging the facial skin and the like by sucking.

BACKGROUND OF THE INVENTION

Generally, in case of conducting a facial treatment when making-up one's face and the like, a facial cream and the like is applied on the face to massage the skin spreading and extending the cream by hands. This massage quickens the circulation of the blood, stimulates and refreshes the skin to give a beautiful bare skin. It is convenient if such a treatment can be conducted by using a device with an automatic suction operation since an easy treatment can be done without trouble or labor, the massage of the whole face can be done uniformly and stain in pore of the skin is sucked to remove. For this purpose, a scution device and the like using reciprocate piston type suction pump is developed and partially used. However, in the suction device, there are disadvantages that the skin is hurt because of too large suction force and that users feel unpleasant because of too large noise occurred by driving the suction pump. It is difficult for the conventional device to conduct the effective facial treatment comfortably.

OBJECT OF THE INVENTION

Accordingly, the object of the invention is to provide a suction device with appropriate suction force and small operation sound of the suction pump.

DISCLOSURE OF THE INVENTION

In order to accomplish the above-mentioned object, a suction device according to the present invention comprises a hollow case having a suction opening, a suction pump included in said case and a driving motor for said suction pump, which is characterized in that said suction device comprises a bottom plate, a diaphragm made of flexible material and disposed on said bottom pate, said diaphragm forming in a dome section, first and second cutting portions formed at the end part of said diaphragm, a suction valve made of flexible material extending from the wall to the center of the first cutting portion, an exhaust valve made of flexible material extending from the wall to the center of said second cutting portion, a suction cylinder of which the one end opening faces said suction valve and another end opening extends to a suction opening of said hollow case, an exhaust passage of which the one end faces said exhaust valve and the another end extends to outside, first and second long grooves disposed on said bottom plate and extending from the dome section of said diaphragm to said first and second cutting portions, wherein the dome section of said diaphragm is connected with an eccentric shaft disposed at a driving axis of said motor to move up and down.

EFFECT OF THE INVENTION

That is, the suction device according to the invention does not comprise a psiton but a diaphragm having a suction valve and an exhaust valve. And said suction valve and exhaust valve are formed in a flexible or elastic thin plate form. Therefore, the suction force is arranged appropriately for a facial treatment, and at the same time noise occurred at the use is small, so that the facial treatment can be done pleasantly. When the treatment is conducted on a wide part such as cheek and on a narrow part such as surroundings of eyes, it is possible to conduct a treatment corresponding to the use every time by selecting properly and adapting different type adaptor to the tip part of a suction cylinder of the suction device. Furthermore, it is possible to prevent foreign substance from entering the suction pump by providing a filter in this suction cylinder, thereby the life of the suction device is extended and at the same time the cleanness of the suction device is maintained.

EMBODIMENT

Followings are descriptions in detail of embodiments according to the present invention.

Figure 1:
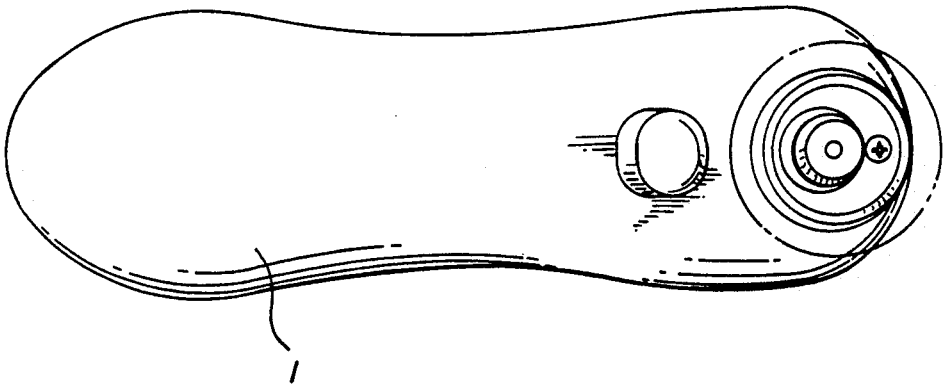
FIG. 1 illustrates, in plan view, an embodiment according to the present invention.
Figure 2:
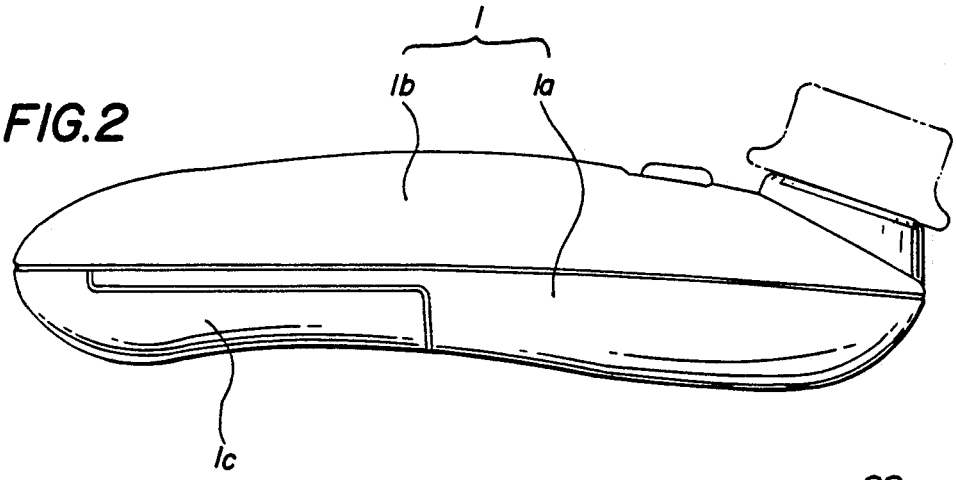
FIG. 2 illustrates, in front view, the same.
Figure 3:
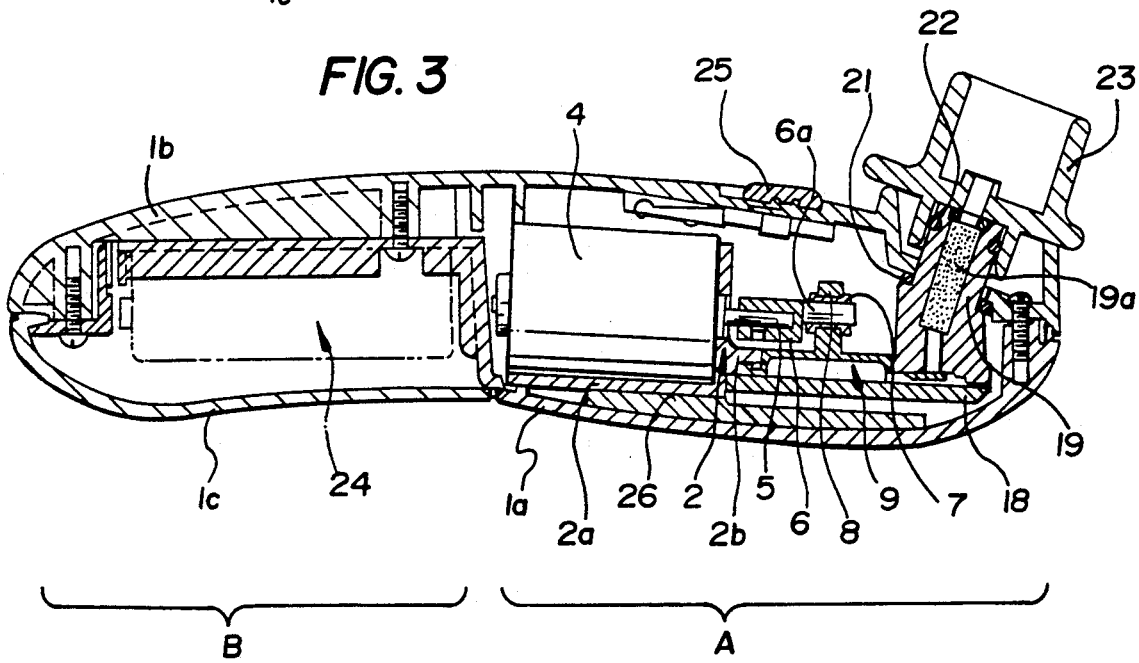
FIG. 3 illustrates, in vertical section, the same.
Figure 4:
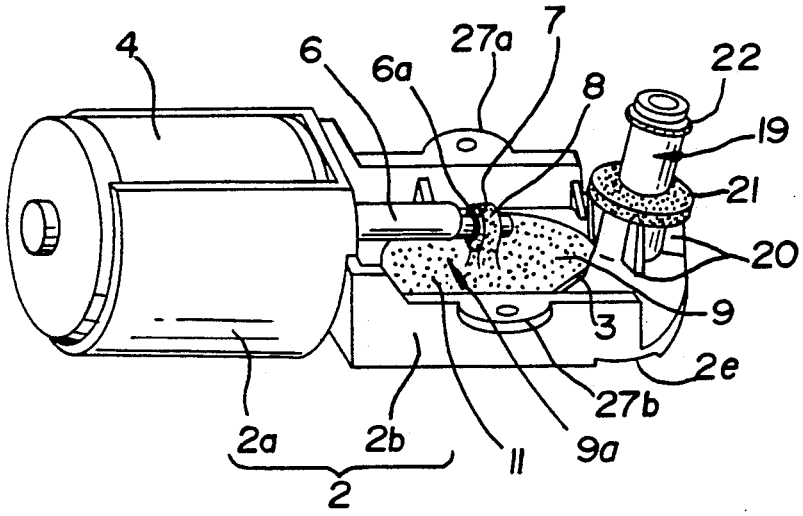
FIG. 4 illustrates, in perspective view, a main part thereof.
Figure 6:
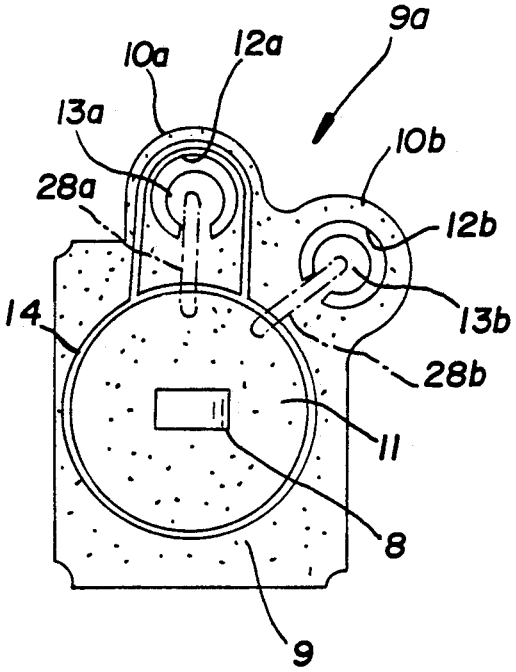
FIG. 6 illustrates, in plan view, a diaphragm used therein, (a), (b), (c), (d) and (e) of FIG. 7 illustrate, in explanatory view, operation of an exhaust valve, and (a), (b), (c), (d) and (e) of FIG. 8 illustrate, in explanatory view, operation of a suction valve.
Figure 5:
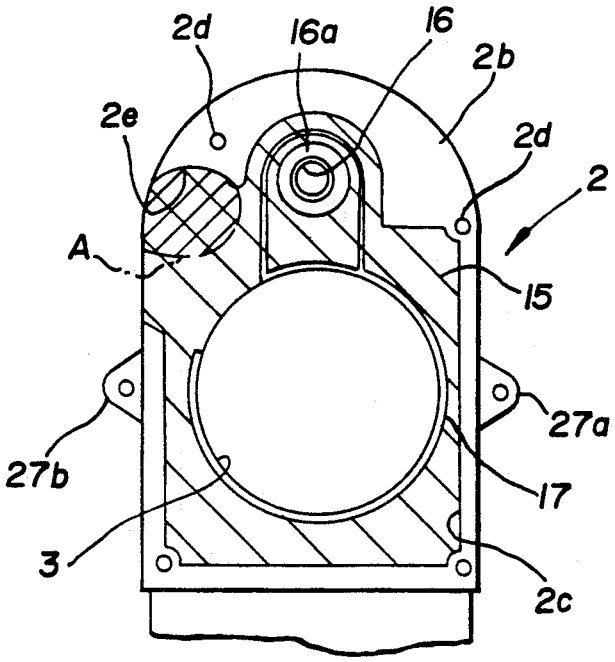
FIG. 5 illustrates, in back view, a flat section of a support base.

FIGS. 1 to 3 illustrate an embodiment of a suction device according to the present invention. That is, in these figures, the reference numeral 1 indicates a cylinder-like case of which the middle portion is constricted in order to gripped easily. Said case 1 is made by fitting a semi-cylindrical upper case 1b on a semi-cylindrical lower case l*a*. the reference numeral 1*c* indicates a battery accommodation section cover disposed at said lower case 1*a* and provided removably. This suction device is divided into two, front and rear. The front part is formed as a suction pump block A and the rear part is formed as a battery block B. In the suction pump block A, a diaphragm pump type suction pump 9*a* and a motor 4 for driving it are accommodated. In the battery block B, battery or batteries 24 for supplying electric power to the motor 4 are accomodated. Said suction pump 9*a* and the driving motor 4 are disposed at a support base 2 integrally formed as shown in FIG. 4. The left part of the support base 2 in the figure is formed semi-cylindrical part 2*a* and the motor 4 is disposed therein in a state that the rotation axis 5 (invisible for concealment) of the motor is inserted into a setting hole (invisible for concealment) disposed on a interior wall. The reference numeral 6 indicates an eccentric shaft disposed at the rotation axis and 6*a* indicates its eccentric axis. The reference numeral 11 indicates a dome section of a diaphragm 9 to be mentioned later and 8 indicates a projection for fixing disposed at the summit thereof. The eccentric axis 6*a* of the motor 4 is inserted at the center of the projection 8 through a metal ring 7. By this, the dome section 11 of the diaphragm 9 moves reciprocately, up and down (see the drawing), by eccentric rotation of the eccdentric axis 6*a*. The right part of said support base 2 in the figure forms a plate form section 2*b* having side walls at both right and left edges. The reference numerals 27*a*, 27*b* indicate setting portions disposed at both right and left side walls respectively. Said plate form section 2b has a cutting portion 3 at its center and a suction cylinder 19 is planted in the front end of the plate form section 2b (the right side in the drawing). A filter 19a is accommodated exchangeably in said suction cylinder 19 as shown in FIG. 3. In FIG. 4, the reference numeral 20 indicates a reinforcing rib, 21 indicates a rubber ring for vibration prevention of the suction cylinder 19 and 22 indicates a ring form seal material disposed at the front end of the suction cylinder 19. In the back surface of said plate form section 2b of the support base 2, a recess 2c (shown in hatching) is formed as shown in FIG. 5 (a back view in a state that the diaphragm 9 is removed from FIG. 4). In the FIG. 5, the reference numeral 3 indicates a center hole and 16 shows a suction hole of the suction cylinder 19. A ring form groove 16a is formed around the suction hole surrounding it. Projections 17, which are low, are formed at circumference of said center hole 3, the surrounding edge section and the hole edge portion of the suction hole 16. The reference numeral 2d is a screw hole. The diaphragm 9 comprises a flexible or elastic plate made of rubber as shown in FIG. 6. The whole shape of the diaphragm 9 is formed to fit the whole shape of the recess 2c disposed at the back surface of said flat section 2b and the center portion thereof is formed as a dome section 11 so that it fits the center hole 3 of the flat section 2b. A thin plate suction valve 13a which corresponds to the suction hole 16 disposed at the back surface of said flat section 2b is formed at a semi-circular projection 10a of said diaphragm 9 on the same plane as the surface of the semi-circular projection 10a and movably up and down, and a thin plate exhaust valve 13b is also formed at a semi-circular projection 10b on the same plane as the back surface of the semi-circular projection 10b. The reference numerals 12a, 12b indicate cutting portions at the circumference of valves 13a, 13b respectively. The reference numeral 14 indicates a shallow concave groove corresponding to the projections 17 at the back surface of said flat section 2b. The diaphragm 9 is unified with said flat section 2b shown in FIG. 4 by positioning the dome section 11 in the center hole 3 of the flat section 2b and pressing the diaphragm 9 against the flat section 2b in a state that the suction valve 13a is fitted with the suction opening 16 of the flat section 2b in FIG. 5 and the exhaust valve 13b is fitted with the semi-circular cutting portion 2e, which is lower by one step than the bottom of the recess 2c, surrounded by chain line A of the plate form section 2b. By this, the diaphragm 9 is fitted with the recess 2c at the back surface of the flat section 2b shown in FIG. 5 and the dome section 11 in the middle of the diaphragm 9 is protruded upward slightly from the center hole 3 of the flat section 2b as shown in FIG. 3. The concave groove 14 of the diaphragm 9 is engaged with the projection 17 at the back surface of the flat section 2b. By unifying said diaphragm 9 and the flat section 2b, the surface of the diaphragm 9 contacts closely the bottom part of th recess 2c shown in chain line in FIG. 5. In this case, the bottom part (surrounded portion in chain line A) corresponding to the semi-circular projection 10b having the exhaust valve 13b is lower by one step, so that at this part, a clearance is formed between the bottom of the recess 2c and the diaphragm 9. In this state, a fixing projection 8 planted at the dome section 11 is in connection with the eccentric axis 6a of the motor 4. And a bottom plate 18 is disposed at the back surface of the diaphragm 9 by utilizing a screw hole 2e of the support base 2. Thus the support base 2 with the motor 4 and the diaphragm 9 is fixed with the suction pump block A by utilizing setting portions 27a, 27b of the support base 2 as shown in FIG. 3.

Thereby, the surrounding edge section of the diaphragm 9 is held and fixed between the flat section 2b of the support base 2 and the bottom plate 18. Long groove 28a which extends from the part corresponding to the dome section 11 of the diaphragm 9 to the part corresponding to a cutting portion 12a is formed on the surface of said bottom plate 18 as shown in FIGS. 6 and 7. A suction opening 16 is opened and closed by a suction valve 13a which is disposed at the upper side of the cutting portion 12a. When the suction valve 13a is open, since the tip opening of the suction cylinder 19 is communicated with the inside of the dome section 11 of the diaphragm 9 through the cutting portion 12a and the long groove 28a, the suction can be conducted from the tip opening of the suction cylinder 19. A long groove 28b which extends from the part corresponding to the dome section 11 of the diaphragm 9 to the part corresponding to a cutting portion 12b is formed on the surface of said bottom plate 18 as shown in FIGS. 6 and 8. Said long groove 28b is opened and closed by an exhaust valve 13b which is disposed at the lower side of the cutting portion 12b. In this case, as shown in FIG. 5, since the part surrounded by a chain line A is lower by a step in the recess 2c of the back of the support base 2, the part 10b of the diaphragm 9 corresponding thereto is not in contact with the base of the recess 2c and forms the clearance connected to the atmosphere. As a result, when the exhaust valve 13b is open, the inner side of the dome section 11 of the diaphragm 9 is in communication with the outside through the long groove 28b and the above clearance, thereby the air in the dome can be exhausted outside. In FIG. 3, an adapter 23 which is cylindrical form and has large diameter from halfway is disposed removably at the tip of the suction cylinder 19, and a battery 24 is accommodated in a battery block B, the numeral 25 indicates a switch, and vibration inhibition sheet 26 is disposed at the bottom of the support base 2.

At first, a facial cream is applied on a face and extended to fit the skin. Then, the switch 25 is turned on to start the motor 4, and the suction device is moved along the surface of the face during the tip opening of the adapter 23 is pressed slightly on the face. As a result, the air of the adapter 23 is sucked from the suction cylinder 19 into the inside of the dome section 11 by means of pumping function of the diaphragm 9 in the dome section 11 through the filter 19a. by this suction force, the cream is sucked, the facial skin is stimulated and the massage effect is occurred. In this case, the above suction force is occurred as shown in FIG. 7 and FIG. 8. When the projection for fixing 8 of the diaphragm 9 is lifted by the lifting force of the eccentric shaft 6 occurred by driving the motor 4, said lifting force is transmitted to the whole of the diaphragm 9. Thereby, the inner space of the dome section 11 expands as shown in FIG. 7 (a) and FIG. 8 (*a*) to be in a state of negative pressure. In this case, the root portion of the exhaust valve 13b is pulled upwardly and pressed to the edge of the flat section 2b. The tip side of the exhaust valve 13b goes down along the above edge as the fulcrum, and closes the long groove 28b, thereby the inner side of the dome section 11 is blockaded. In that time, the root portion of the suction valve 13a is also pulled upwardly and the tip side thereof goes down along the flat section 2b in the vicinity of the suction hole 16 as the flucrum, thereby the suction hole 16 is opened. As a result, the air in the adapter 23 is sucked into the inner side of the above dome section 11 through the suction cylinder 19, the cutting portion 12*a* and the long groove 28*a*. Then the eccentric shaft 6 rotates, and the projection for fixing is brought down from the above state by lifting force occurred by the rotation. Thereby, the inner space of the dome section 11 is contracted as shown in (b) and (c) of FIG. 7 and (b) and (c) of FIG. 8. Accordingly, the air in the dome section 11 is compressed, pushed up the exhaust valve 13*b* and flows out by the pressure. At that time, the suction valve 13*a* is pushed up by the pressure of the air in the dome section 11, thereby the suction hole 16 of the suction cylinder 19 is blockaded, and then it prevents the air in the dome section 11 from flowing back to the suction cylinder 19.

Next, the eccentric shaft 6 rotates, and the projection for fixing 8 is lifted again. Thereby, the inner space in the dome section 11 expands to be negative pressure state as shown in (d) and (e) of FIG. 7. The exhaust valve 13*b* closes the long groove 28*b*, the suction valve 13*a* opens the suction hole 16 of the suction cylinder 19, thereby the air in the adapter 23 is sucked into the inside of the dome section 11. Such an operation is repeated at regular cycle to conduct the suction operation. The adapter 23 can be exchanged according to the using condition at using the above suction device. In the case that a wide part such as, cheek and neck is treated, the adapter having large diameter is used. In the case that the suction force is too strong, the attachment made of the synthetic rubber is applied to the tip of the adapter, thereby the narrow part, such as, lower side of nose and surroundings of eye, can be treated. In the case that a part except the above is treated, an adapter having the different diameter from the above or the ellipsoidal caliber is used.

As mentioned above, with the suction device according to the embodiment, by a cleansing effect of cream, a suction effect and a massage effect that facial skin is stimualted, the circulation of the blood is quickened, the skin becomes beautiful and is refreshed, and the user feels good. Since the suction valve 13*a* and the exhaust valve 13*b* are made of the thin rubber plate to make the occured sound small, and further since the vibration inhibition sheet 26 is disposed at the bottom side of the case 1 and the rubber ring 21 for vibration inhibiting is disposed between the reinforcing rib 20 of the suction cylinder 19 and the upper case 1*b*, the vibration is absorbed and the suction device is pleasantly used. Since the air to be exhausted flows from the gap of the diaphragm 9 and the support base 2 into the hollow case and it is exhausted outside from the clearance of fitting parts of upper and lower hollow cases, the exhaustion is smoothly conducted and also the inside of the hollow case is automatically cleansed. Further, since the filter 19*a* is accommodated in the suction cylinder 19, the foreign substance does not enter from outside, the life of the motor 4 is extended and the clean condition is maintained in the inside of the suction device. Application at using becomes sharply large by exchanging the adapter 23 according to the using condition.

We claim:

1. A facial massage including a suction device comprising a hollow case having a suction opening, a suction pump included in said case and a driving motor for said suction pump, which is characterized in that said suction device comprises a bottom plate, a diaphragm made of flexible material and disposed on said bottom plate, said diaphragm forming a dome section, first and second cutting portions formed at the end part of said diaphragm, a suction valve made of flexible material extending from the wall to the center of the first cutting portion, an exhaust valve made of flexible material extending from the wall to the center of said second cutting portion, a suction cylinder of which the one end opening faces said suction valve and another end opening extends to a suction opening of said hollow case, an exhaust passage of which the one end faces said exhaust valve and the another end extends to outside, first and second long grooves disposed on said bottom plate and extending from the dome section of said diaphragm to said first and second cutting portions, wherein the dome section of said diaphragm is in connection with an eccentric shaft disposed at a driving axis of said motor to move up and down.

2. A facial massager as defined in claim 1, wherein a plurality of differently shaped adapters can be applied exchangeably at the tip opening of the suction cylinder.

3. A facial massager as defined in claim 1, wherein a filter is included in the suction cylinder.

* * * * *

UNITED STATES PATENT AND TRADEMARK OFFICE

CERTIFICATE OF CORRECTION

PATENT NO. : 5,003,966

DATED : April 2, 1991

INVENTOR(S) : Kenji SAKA et al

It is certified that error appears in the above-identified patent and that said Letters Patent is hereby corrected as shown below:

On the title page, Item [73] -- Key Trading Co., Ltd, Osaka, Japan -- should be added.

Column 2, line 38, delete "the", and insert therefor -- The --.

Column 3, line 41, before "shown", insert -- as --.

Column 3, line 58, delete "th", and insert therefor -- the --.

Claim 1, line 1, delete "massage", and insert therefor -- massager --.

Signed and Sealed this

Twentieth Day of October, 1992

*Attest:*

DOUGLAS B. COMER

*Attesting Officer*

*Acting Commissioner of Patents and Trademarks*